US010156385B1

(12) United States Patent
Kapsha

(10) Patent No.: US 10,156,385 B1
(45) Date of Patent: Dec. 18, 2018

(54) MULTISTAGE REFRIGERATION SYSTEM

(71) Applicant: Christopher Kapsha, Deer Isle, ME (US)

(72) Inventor: Christopher Kapsha, Deer Isle, ME (US)

( * ) Notice: Subject to any disclaimer, the term of this patent is extended or adjusted under 35 U.S.C. 154(b) by 0 days.

(21) Appl. No.: 15/677,353

(22) Filed: Aug. 15, 2017

(51) Int. Cl.
*F25B 1/10* (2006.01)
*F25B 41/00* (2006.01)
*F25B 49/02* (2006.01)

(52) U.S. Cl.
CPC ..... *F25B 1/10* (2013.01); *F25B 41/003* (2013.01); *F25B 49/02* (2013.01); *F25B 2600/2507* (2013.01)

(58) Field of Classification Search
CPC ..... F25B 1/10; F25B 41/003; F25B 49/02; F25B 2600/2507
See application file for complete search history.

(56) References Cited

U.S. PATENT DOCUMENTS 3,563,305 A 2/1971 Hay
4,367,634 A 1/1983 Bolton
4,382,466 A 5/1983 Shiraishi
6,477,847 B1 11/2002 Bonaquist et al.
6,550,255 B2 4/2003 Rudick
7,077,189 B1 7/2006 Reyzin et al.
7,398,779 B2 7/2008 Bowen et al.
2005/0284169 A1 12/2005 Tamura et al.
2006/0086140 A1 4/2006 Eaton et al.
2007/0028626 A1 2/2007 Chen
2010/0319681 A1 12/2010 Li
2015/0377541 A1* 12/2015 Yoshikawa ..... F25B 1/10 62/140

OTHER PUBLICATIONS

Chapp, Terry L, "Minimizing Ammonia Charge in Industrial Refrigeration Systems, Part 2", [Online]. Retrieved from the Internet: <URL:http://contractingbusiness.com/refrigeration/minimizing-ammonia-charge-industrial-refrigeration-systems-part-2>, (Nov. 19, 2015).

(Continued)

*Primary Examiner* — Ana Vazquez
(74) *Attorney, Agent, or Firm* — Schwegman Lundberg & Woessner P.A.

(57) ABSTRACT

Various examples are directed to a multistage refrigeration system comprising a vapor compression cycle (VCC) stage, a thermosiphon stage, and an interface device. The VCC stage may circulate a VCC refrigerant, for example, to work a vapor compression cycle on the VCC refrigerant. The thermosiphon stage may circulate a thermosiphon refrigerant between the interface device and an evaporator. The interface device may comprise an interface flow path in fluid communication with the VCC stage to receive the VCC refrigerant and a first vessel that at least partially encloses the first interface flow path. The vessel may receive the first thermosiphon refrigerant at least partially in a vapor phase and may provide the first thermosiphon refrigerant to the evaporator at least partially in a liquid phase. The vessel may be at a second elevation, higher than the first elevation, to generate a thermosiphon force to circulate the thermosiphon refrigerant between the vessel and the evaporator.

20 Claims, 5 Drawing Sheets

(56) References Cited

OTHER PUBLICATIONS

Kapsha, Chris, et al., "Refrigerant Selection for Industrial Refrigeration", Process Cooling Refrigeration Systems 2014, (Mar. 3, 2014), 5 pgs.
Kapsha, Chris, et al., "Secondary Refrigerants: The Benefits and Costs", Process Cooling 2015, (May 19, 2015), 6 pgs.
Stoecker, Wilbert F., "Industrial Refrigeration Handbook (Mechanical Engineering)", McGraw-Hill, pp. 170-171 and 285-286, (1998), 4 pgs.

* cited by examiner

MULTISTAGE REFRIGERATION SYSTEM

TECHNICAL FIELD

The examples in this description and drawings generally relate to refrigeration systems, for example, multistage refrigeration systems.

BACKGROUND

Vapor compression cycle (VCC) refrigeration systems are used in many different applications to remove heat from a process area. VCC refrigeration systems typically include a compressor, a condenser, an expansion device, an evaporator, and a working fluid (often called a refrigerant). The refrigerant flows between, and is acted upon by, the compressor, condenser, expansion device, and evaporator. The compressor receives the refrigerant in a vapor phase at a low temperature and pressure. The compressor compresses the refrigerant, resulting in a high pressure, high temperature refrigerant. At the condenser, the high temperature, high pressure refrigerant releases heat energy and condenses to a liquid, resulting in a high pressure, high temperature refrigerant in a liquid phase. Next, the high temperature, high pressure liquid refrigerant is provided to an expansion device, which may be a valve or similar device. At the expansion device, the refrigerant expands, resulting in a low pressure, low temperature liquid. Finally, at the evaporator, the low pressure, low temperature liquid absorbs heat and evaporates to a low pressure, low temperature gas, which is provided again to the compressor.

In a VCC refrigeration system, the evaporator is typically placed in thermal communication with a process area to be cooled. This allows the evaporator to absorb heat from the process area. The absorbed heat is emitted at the condenser, which is typically positioned outside of the process area. In this way, the VCC refrigeration system removes heat from the process area and deposits it at the location of the condenser.

DRAWINGS

In the drawings, which are not necessarily drawn to scale, like numerals may describe similar components in different views. Like numerals having different letter suffixes may represent different instances of similar components. Some embodiments are illustrated by way of example, and not of limitation, in the figures of the accompanying drawings, in which.

DETAILED DESCRIPTION

Figure 1:
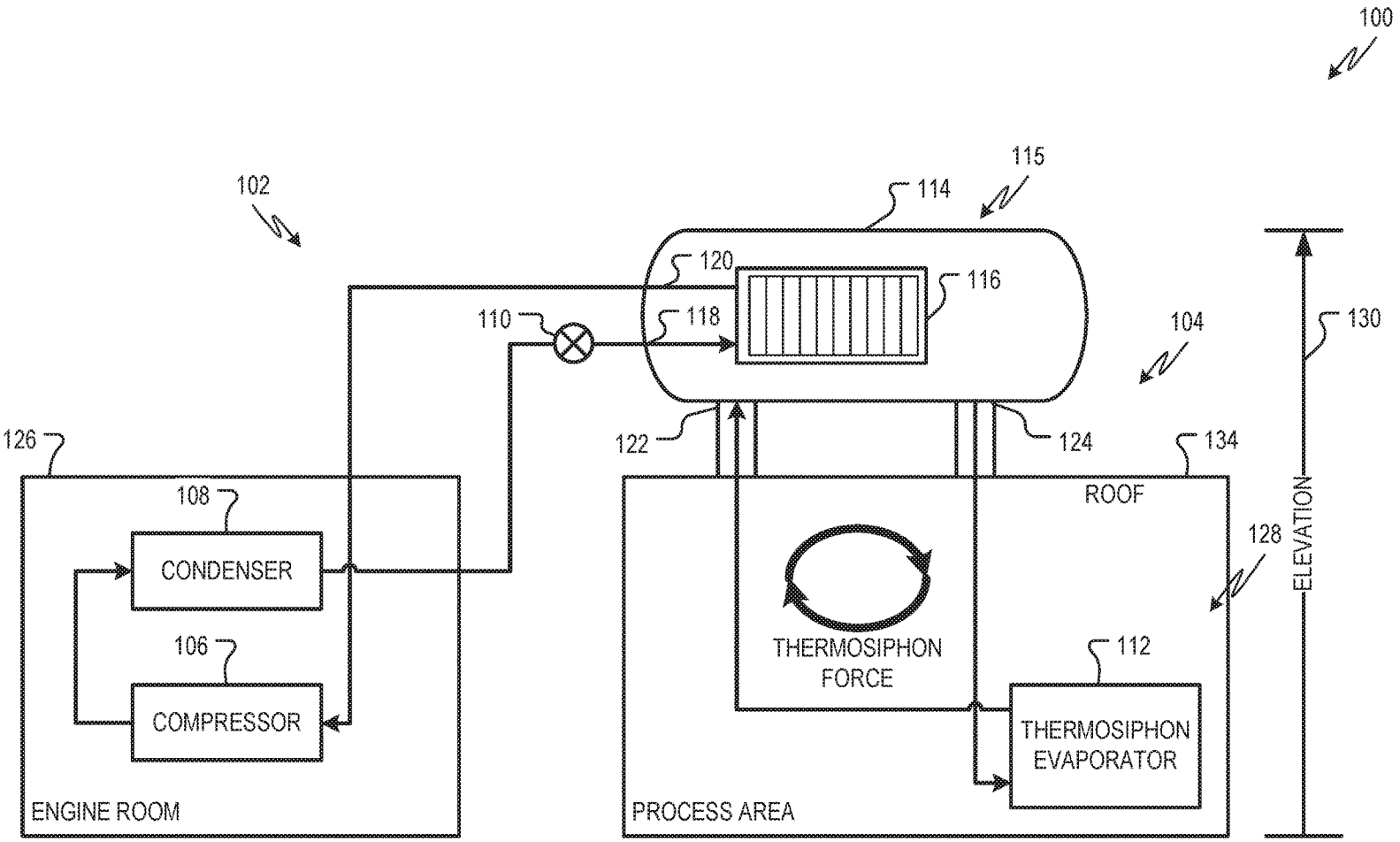
FIG. 1 is a block diagram showing one example of a multistage refrigeration system comprising a VCC stage, a thermosiphon stage, and an interface device.

Various examples described herein are directed to multistage refrigeration systems having a VCC stage and a thermosiphon stage. The VCC stage works a VCC refrigerant through a vapor compression cycle. At an interface device, the VCC refrigerant absorbs heat that is released from a thermosiphon refrigerant circulating at the thermosiphon stage. When the thermosiphon refrigerant releases heat to the VCC refrigerant, the enthalpy or total heat content of the thermosiphon refrigerant may be reduced, allowing the thermosiphon refrigerant to more readily absorb heat. The lower-enthalpy thermosiphon refrigerant is provided to a thermosiphon evaporator. At the thermosiphon evaporator, the thermosiphon refrigerant may absorb heat from a process area, thus cooling the process area and raising the enthalpy of the thermosiphon refrigerant.

The thermosiphon stage may be arranged to generate a thermosiphon effect to provide a motive force that circulates the thermosiphon refrigerant between the interface device and the thermosiphon evaporator. The interface device may be positioned above the thermosiphon evaporator (e.g., on a roof over the process area). Higher-enthalpy thermosiphon refrigerant existing the thermosiphon evaporator after absorbing heat from the process area may be more buoyant than lower-enthalpy thermosiphon refrigerant at the interface device. Because the higher-enthalpy thermosiphon refrigerant is more buoyant, it may rise to the interface device. At the interface device, the higher-enthalpy thermosiphon refrigerant releases heat. This may reduce the enthalpy of the thermosiphon refrigerant and also reduce its buoyancy. The now lower-enthalpy, less buoyant thermosiphon refrigerant sinks back to the thermosiphon evaporator.

In some implementations, the examples described herein allow a more advantageous selection of refrigerants with fewer trade-offs between positive and negative refrigerant properties. For example, many common industrial refrigerants with suitable thermodynamic properties also present significant hazards if spilled and/or have a very high cost. For example, ammonia is commonly used as a refrigerant because of its favorable thermodynamic properties. Ammonia, however, can present considerable disadvantages in the event of a spill. For example, an ammonia spill in a process area may lead to the evacuation of personnel and the spoliation of food or other goods in the process area at the time of the spill. Some proprietary refrigerants, such as Freon® (R-507) available from The Chemours Co., are less hazardous if spilled, but often considerably more expensive than other refrigerants such as ammonia.

In some examples, the VCC stage is arranged to reduce the likelihood of a VCC refrigerant spill and/or mitigate the ill effects of a spill. Because the VCC stage does not directly cool the process area, some examples are arranged to keep the VCC refrigerant completely or substantially outside of the process area. In this way, any VCC refrigerant leaks that do occur may be outside of the process area where the potential harm to people and product is reduced. Also, keeping VCC refrigerant completely or substantially out of the process area may reduce the risk that VCC piping will be breached by human or vehicle activity in the process area. As a result, the VCC stage may utilize ammonia or another lower cost refrigerant with a lesser risk of an expensive and potentially damaging leak of the ammonia into the process area.

Although the thermosiphon refrigerant may be brought into or near the process area to access the thermosiphon evaporator, in some examples, the quantity (e.g., mass) of thermosiphon refrigerant may be less, and sometimes substantially less, than the quantity (e.g., mass) of VCC refrigerant. For example, the components of the thermosiphon stage may be in close physical proximity to one another near the process area. In some examples, the thermosiphon refrigerant circulates from an interface device positioned on a roof of a building including the process area, through the roof, to a thermosiphon evaporator located below the roof in the process area. Because less thermosiphon refrigerant is used, it may be practical to use more expensive refrigerants, such as R-507. Also, because lower quantities of the thermosiphon refrigerant are used, spill risks for refrigerants with undesirable properties may be mitigated. For example, in some implementations, the quantity of thermosiphon refrigerant may be low enough to allow the use of a flammable refrigerant, such as a hydrocarbon, without an excessive risk of fire in the event of a spill.

Another potential benefit of the systems and methods described herein is that the use of powered components (e.g., pumps, compressors, etc.) in the thermosiphon stage may be reduced and, in some examples, eliminated. For example, the motive force provided to the thermosiphon refrigerant by the thermosiphon effect may be sufficient to circulate the thermosiphon fluid without pumps, compressors, or other powered components. This, in turn, may reduce the risk that the thermosiphon refrigerant will become contaminated with oil or lubricants used by powered components. Also, in some examples, it allows the system to be centrally powered by the compressor of the VCC stage, which may improve efficiency.

Yet another potential benefit of the systems and methods described herein is that, in some implementations, a thermosiphon stage may be retrofitted to an existing VCC refrigeration system. For example, consider an existing VCC system that includes a VCC evaporator positioned in a process area. In some examples, the VCC evaporator may be removed from the process area and VCC refrigerant previously provided to the VCC evaporator may be routed to an interface device (e.g., installed on the roof of the process area). The thermosiphon evaporator may be positioned in the process area and connected to receive thermosiphon refrigerant circulated from the interface device above. Also, in some examples, a thermosiphon stage, as described herein, may be added to an existing VCC refrigeration system to refrigerate a new process area. Retrofitting a thermosiphon stage, in some examples, is simpler than retrofitting other types of secondary stages, such as VCC stages or CO2 stages in volatile brine systems. For example, retrofitting a thermosiphon stage may not involve adding powered or high pressure components. Also, in some examples, retrofitting a thermosiphon stage may not require redesigning the existing VCC system/stage.

FIG. 1 is a block diagram showing one example of a multistage refrigeration system 100 comprising a VCC stage 102, a thermosiphon stage 104, and an interface device 115. The VCC stage 102 may comprise a compressor 106, a condenser 108, and an expansion device 110 in fluid communication with one another to circulate a VCC refrigerant. The thermosiphon stage 104 may comprise a thermosiphon evaporator 112 and may circulate a thermosiphon refrigerant, as described herein.

The interface device 115 may thermally couple the VCC stage 102 and the thermosiphon stage 104. The interface device 115 may comprise an interface flow path 116 in fluid communication with the compressor 106, condenser 108, and expansion device 110 of the VCC stage 102. For example, an input 118 of the interface flow path 116 may be in direct or indirect fluid communication with the expansion device 110 such that VCC refrigerant circulates from the expansion device 110 to the input 118. An output of the interface flow path 116 may be in direct or indirect fluid communication with the compressor 106, for example, such that VCC refrigerant circulates from the output 120 of the interface device 115 to the compressor 106.

The interface device 115 may also comprise a vessel 114 in fluid communication with the thermosiphon evaporator 112. A vessel input 122 is in direct or indirect fluid communication with the thermosiphon evaporator 112 to receive thermosiphon refrigerant. A vessel output 124 is in fluid communication with the thermosiphon evaporator 112 to provide thermosiphon refrigerant, as described herein.

The interface flow path 116 and interface vessel 114 may be in thermal communication with one another to allow the VCC refrigerant at the interface flow path 116 to absorb heat from thermosiphon refrigerant at the vessel 114. Any suitable structure may be used to generate thermal communication between the interface flow path 116 and vessel 114. In some examples, the interface device 115 may be or include a shell-and-tube heat exchanger comprises a tube portion and a shell portion. The tube portion may include one or more tubes. The shell portion may enclose at least part of the tube portion to put the refrigerant circulating in the tube portion in thermal communication with refrigerant in the shell portion. For example, the interface flow path 116 may comprise some or all of a tube portion of the shell-and-tube heat exchanger. The vessel 114 may comprise some or all of a shell portion of the shell-and-tube heat exchanger. In another example, the interface device 115 may be or include a plate and shell heat exchanger. The plate and shell heat exchanger may comprise a plate flow path that routs refrigerant between a set of plates and a shell portion that encloses at least part of the plate flow path to put refrigerant in the plate flow path in thermal communication with refrigerant in the shell portion. The interface flow path 116 may comprise some or all of a plate flow path of the plate-and-shell heat exchanger and the vessel 114 may comprise some or all of a shell portion of the plate-and-shell heat exchanger. In some examples, the interface flow path 116 comprises a plate pack or similar plate flow path positioned within a surge drum, where the surge drum constitutes all or part of the vessel 114.

The VCC stage 102 may work a vapor compression cycle on the VCC refrigerant with the interface flow path 116 acting as the evaporator for the vapor compression cycle. For example, the compressor 106 may receive the VCC refrigerant substantially as a vapor at low temperature and low pressure. The compressor 106 may compress the VCC refrigerant and provide the VCC refrigerant to the condenser 108 at high temperature and high pressure. The condenser 108 may release heat energy from the VCC refrigerant and condense it to a liquid, providing a high pressure, high temperature liquid refrigerant to the expansion device 110. At the expansion device 110, the VCC refrigerant may expand and cool to a low pressure and low temperature. The low pressure, low temperature VCC refrigerant is provided to the input 118 of the interface flow path 116. At the interface flow path 116, the VCC refrigerant may absorb heat from the thermosiphon refrigerant and may substantially evaporate to a vapor phase at low temperature and pressure. From the interface flow path 116, the low temperature, low pressure VCC refrigerant may be provided again to the compressor 106, where the cycle continues.

Referring to the thermosiphon stage 104, higher-enthalpy thermosiphon refrigerant from the thermosiphon evaporator 112 is received at the vessel 114 via the vessel input 122. In the vessel 114, the higher-enthalpy thermosiphon refrigerant releases heat to the VCC refrigerant at the interface flow path 116, which lowers the enthalpy of the thermosiphon refrigerant. The resulting lower-enthalpy thermosiphon refrigerant is returned to the thermosiphon evaporator 112. At the thermosiphon evaporator 112, the lower enthalpy thermosiphon refrigerant absorbs heat from a process area 128, thus cooling the process area 128.

The motive force to circulate the thermosiphon refrigerant may be provided by generating a thermosiphon force between the vessel 114 of the interface device 115 and the thermosiphon evaporator 112. For example, interface device 115 may be at a higher elevation than the thermosiphon evaporator 112, illustrated by the elevation scale 130. The absorption and release of heat by the thermosiphon refrigerant at the thermosiphon evaporator 112 and the interface device 115, respectively, may generate a temperature and/or density gradient in the thermosiphon refrigerant between the interface device 115 and thermosiphon evaporator 112. For example, when the thermosiphon refrigerant absorbs heat at the thermosiphon evaporator 112, it may also become less dense and more buoyant. Higher-enthalpy, less-dense thermosiphon refrigerant may rise from the thermosiphon evaporator 112 to the vessel 114 of the interface device 115. When the thermosiphon refrigerant releases heat at the interface device 115, it may also become more dense and less buoyant. The lower-enthalpy, less-dense thermosiphon refrigerant may sink down to the thermosiphon evaporator 112, continuing the cycle.

The system 100 may be configured to manifest the changes in thermosiphon enthalpy that take place at the interface device 115 and the thermosiphon evaporator 112 in any suitable manner. In some examples, all or part of the thermosiphon refrigerant changes phase at the thermosiphon evaporator 112 and/or at the interface device 115. For example, the lower-enthalpy thermosiphon refrigerant received at the thermosiphon evaporator 112 from the interface device may include saturated or near-saturated liquid. When the saturated or near-saturated liquid thermosiphon refrigerant absorbs heat at the thermosiphon evaporator 112, it may change phase from a liquid phase to a vapor phase. The phase change at the thermosiphon evaporator 112 may or may not be accompanied by a temperature change. In some examples, the thermosiphon refrigerant absorbs enough heat at the thermosiphon evaporator 112 to change the phase of the thermosiphon refrigerant and change (e.g. raise) its temperature. In other examples, the thermosiphon refrigerant and/or other components of the system 100 are arranged such that the temperature of the thermosiphon refrigerant does not change or does not substantially change at the thermosiphon evaporator 112.

Similarly, the higher-enthalpy thermosiphon refrigerant received at the interface device, in some examples, includes saturated or near-saturated vapor. When the saturated or near-saturated vapor thermosiphon refrigerant releases heat at the interface device, it may change phase from a vapor phase to a liquid phase. The phase change at the interface device may or may not be accompanied by a temperature change. In some examples, the thermosiphon evaporator releases enough heat at the interface device 115 to change its phase and change (e.g., lower) its temperature. In other examples, the thermosiphon refrigerant and/or other components of the system 100 are arranged such that the temperature of the thermosiphon refrigerant does not change or does not substantially change at the interface device 115.

In examples where the thermosiphon refrigerant changes phase at the thermosiphon evaporator 112 and/or at the interface device 115, different proportions of thermosiphon refrigerant may change phase depending, for example, on the configuration of the system 100, operating conditions of the system 100, etc. In some examples, all of the thermosiphon refrigerant that is received at the vessel input 122 of the interface device 115 is in the vapor phase. In some examples, greater than half of the thermosiphon refrigerant that is received at the vessel input 122 is in the vapor phase. In some examples, at least 75% of the thermosiphon refrigerant that is received at the vessel input 122 is in the vapor phase. In some examples, substantially all of the thermosiphon refrigerant that is received at the vessel input 122 is in the vapor phase. In some examples, all of the thermosiphon refrigerant that is output at the vessel output 124 of the interface device 115 towards the thermosiphon evaporator 112 is in the liquid phase. In some examples, greater than half of the thermosiphon refrigerant that is output at the vessel output 124 is in the liquid phase. In some examples, at least 75% of the thermosiphon refrigerant that is output at the vessel output 124 is in the liquid phase. In some examples, substantially all of the thermosiphon refrigerant that is output at the vessel output 124 is in the liquid phase.

In some examples, selecting the thermosiphon refrigerant to bring about a phase change between the thermosiphon evaporator 112 and the vessel 114 may increase the efficiency of the thermosiphon stage 104, causing the thermosiphon stage 104 to move more heat energy from the process area 128 per unit of thermosiphon refrigerant than configurations where the thermosiphon refrigerant experiences a significant temperature change at the interface device 115 and/or the thermosiphon evaporator 112.

FIG. 1 also illustrates one example installation of the multistage refrigeration system 100. For example, compressor 106, condenser 108, and expansion device 110 of the VCC stage 102 are positioned at an engine room 126 that may be separated from the process area 128 by one or more walls. In some examples, the engine room 126 is in a different room or a different building than the process area 128. Although the condenser 108 and is shown within the engine room 126, in some examples, the condenser 108 is positioned outside the engine room 126 to better dissipate heat. The VCC refrigerant is piped from the engine room 126 to the interface device 115. Also, although the compressor 106, condenser 108, and engine room 126 are illustrated at about the same elevation as the process are 128, in some examples, the engine room 126 and VCC stage components 106, 108, 110 may be placed at any suitable elevation relative to the process area 128.

The interface device 115, in some examples, is positioned on a roof 134 of the process area 128 as shown. Piping carrying the VCC refrigerant may also be run on the roof 134 of the process area 128. In some examples, including the example shown in FIG. 1, piping carrying the VCC refrigerant does not pass through the process area 128, thus minimizing the risk of VCC refrigerant spills in the process area 128. In other examples, piping carrying the VCC refrigerant may pass through the process area 128, for example, high on the walls or near the ceiling where it is not likely to be contacted by human or vehicle activity.

Any suitable refrigerants may be selected for use as the VCC refrigerant and/or the thermosiphon refrigerant. In some examples, the VCC refrigerant may be or include ammonia. For example, because the VCC refrigerant has minimal or no presence in the process area 128, the thermodynamic and price benefits of ammonia may be exploited while the risk of spills in the process area 128 is mitigated. For example, spills outside of the process area 128 (e.g., in the engine room 126, on the roof 134 of the process area 128) may be easier to clean and less likely to cause harm to people or things.

In some examples, the thermosiphon refrigerant may be or include carbon dioxide (CO2), glycol or another hydrocarbon, a proprietary refrigerant such as R-507, etc. For example, because the quantity of thermosiphon refrigerant is less than the quantity of VCC refrigerant, the fire hazard associated with using a hydrocarbon refrigerant may be mitigated. Similarly, the cost penalty associated with a proprietary refrigerant, such as R-507, may be reduced because less of it is needed.

Figure 2:
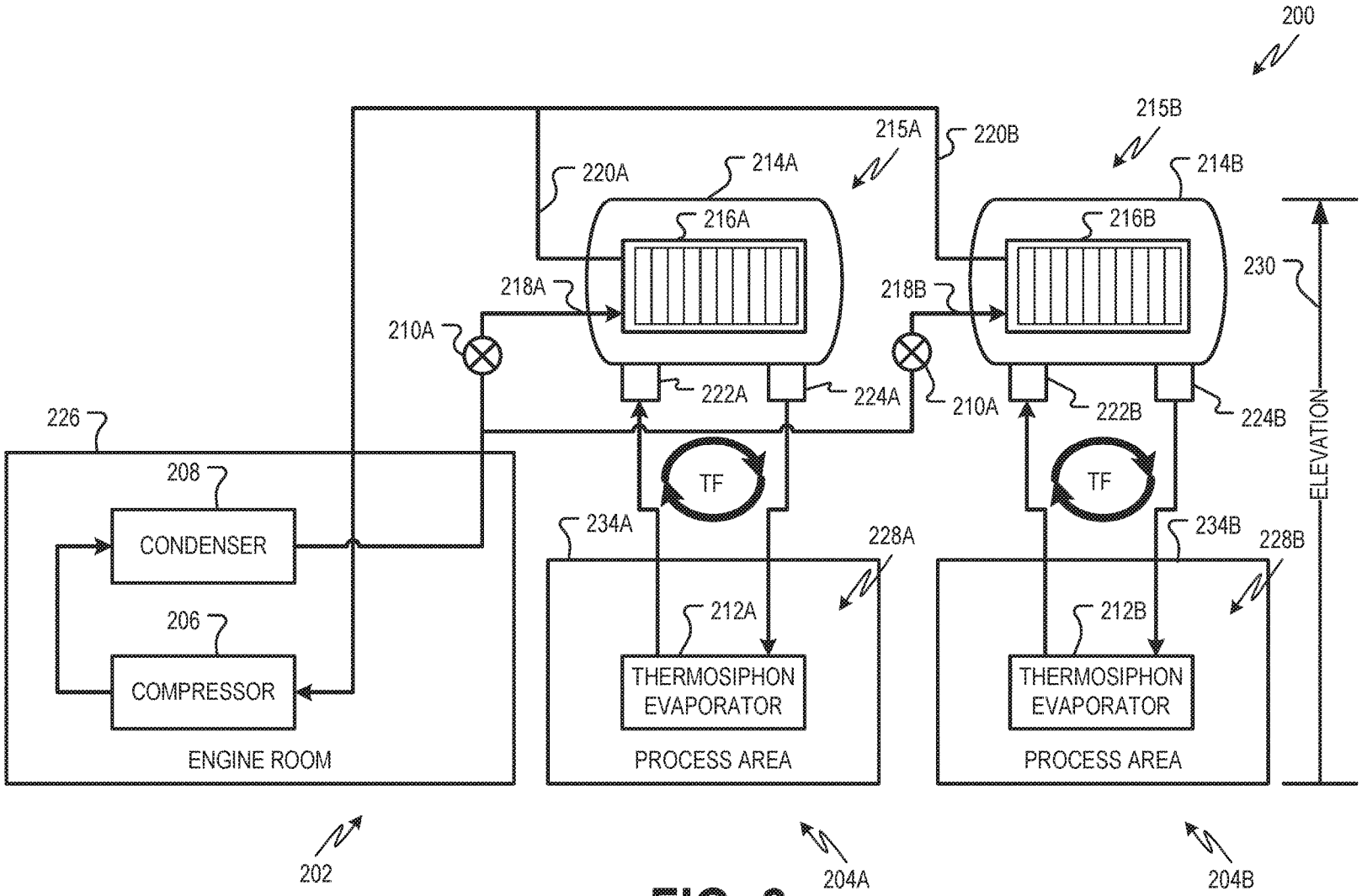
FIG. 2 is a block diagram showing another example of a multistage refrigeration system comprising a VCC stage, two thermosiphon stages, and two interface devices.

FIG. 1 shows an example multistage refrigeration system 100 including a single thermosiphon stage 104. In some examples, however, multistage refrigeration systems may include more than one thermosiphon stage. FIG. 2 is a block diagram showing another example of a multistage refrigeration system 200 comprising a VCC stage 202, two thermosiphon stages 204A, 204B, and two interface devices 215A, 215B. In the example of FIG. 2, a common VCC stage 202 may be used to drive more than one thermosiphon stage. (Two thermosiphon stages 204A, 204B are shown in FIG. 2, but additional thermosiphon stages may be included in some examples.) The thermosiphon stages 204A, 204B may be used, for example, to refrigerate different process areas 228A, 228B. Similar to the system 100, in system 200, some or all of the compressor 206 and/or condenser 208 may be positioned in an engine room 226.

The interface devices 215A, 215B may comprise respective interface flow paths 216A, 216B and vessels 214A, 214B. Inputs 218A, 218B of the respective interface flow paths 216A, 216B may be in direct or indirect fluid communication with one or more expansion devices 210A, 210B of the VCC stage 202 to receive VCC refrigerant. Outputs 220A, 220B of the interface flow paths 216A, 216B may be in direct or indirect fluid communication with the compressor 206 of the VCC stage 202 to provide the VCC refrigerant back to the compressor 206 as part of a vapor compression cycle. In the example of FIG. 2, the interface flow paths 216A, 216B are coupled to the VCC stage 202 in parallel. That is, both of the inputs 218A, 218B are coupled to receive VCC refrigerant directly from the VCC stage 202 (e.g., without the VCC refrigerant first passing through the other interface flow path 216A, 216B).

The interface devices 215A, 215B may also comprise respective vessels 214A, 214B that may at least partially enclose the interface flow paths 216A, 216B. Vessels 214A, 214B may be in fluid communication with respective thermosiphon evaporators 212A, 212B at respective process areas 228A, 228B. For example, inputs 222A, 222B of the respective vessels 214A, 214B may be in direct or indirect fluid communication with the respective thermosiphon evaporators 212A, 212B to receive higher-enthalpy thermosiphon refrigerant. Outputs 224A, 224B of the respective vessels 214A, 214B may provide lower-enthalpy thermosiphon refrigerant to the respective thermosiphon evaporators 212A, 212B.

The common VCC stage 202 of the multistage refrigeration system 200 may comprise a compressor 206, condenser 208, and expansion devices 210A, 210B that may operate in a manner similar to the compressor 106, condenser 108, and expansion device 110 of FIG. 1. (Although FIG. 2 shows an expansion device 210A for the first thermosiphon stage 204A and an expansion device 210B for the second thermosiphon stage 204B, any suitable number of expansion devices may be used including, for example, one or more than two.) The interface flow paths 216A, 216B may both act as condensers for the VCC stage 202. For example, the expansion devices 210A, 210B may generate low pressure, low temperature VCC refrigerant, as described herein. A portion of the low pressure, low temperature VCC refrigerant (e.g., from the expansion device 210A) may be provided to the interface flow path 216A, where it may absorb heat from a first thermosiphon refrigerant of the first thermosiphon stage 204A before being provided back to the compressor 206. A second portion of the low pressure, low temperature VCC refrigerant (e.g., from the expansion device 210B) may be provided to the interface flow path 216B, where it may absorb heat from a second thermosiphon refrigerant of the second thermosiphon stage 204B before being provided back to the compressor 206.

The respective thermosiphon stages 204A, 204B may operate in a manner similar to that of the thermosiphon stage 104 of FIG. 1. For example, respective thermosiphon refrigerant may release heat at the vessels 214A, 214B of the interface devices 215A, 215B. Lower-enthalpy thermosiphon refrigerant may sink to the respective thermosiphon evaporators 212A, 212B where it may absorb heat from the respective process areas 228A, 228B. Interface devices 215A, 215B may be positioned above respective roofs 234A, 234B of the process areas 228A, 228B. This may prompt the creation of thermosiphon forces to circulate the thermosiphon refrigerant. For example, a thermosiphon force between the vessel 214A and the thermosiphon evaporator 212A may provide a motive force to circulate thermosiphon refrigerant at the thermosiphon stage 204A. A thermosiphon force between the vessel 214B and the thermosiphon evaporator 212B may provide a motive force to circulate thermosiphon refrigerant at the thermosiphon stage 204B.

As shown in FIG. 2, the interface devices 215A, 215B may be positioned at respective elevations (indicated by elevation scale 230) that are higher than the respective elevations of the thermosiphon evaporators 212A, 212B. For example, the interface device 215A may be positioned at an elevation higher than the elevation of the thermosiphon evaporator 212A, and the interface device 215B may be positioned at an elevation higher than the elevation of the thermosiphon evaporator 212B. Although both thermosiphon evaporators 212A, 212B are shown at the same elevation in FIG. 2, this may not always be the case. For example, each interface device 215A, 215B may be positioned at an elevation greater than its respective thermosiphon evaporator 212A, 212B, but the interface device 215A and thermosiphon evaporator 212A may be at any suitable elevation relative to the interface device 215B and thermosiphon evaporator 212B. For example, the process areas 228A, 228B may be at different elevations (e.g., at different floors of a building or buildings, at different buildings with different elevations, etc.).

In some examples, the respective thermosiphon stages 204A, 204B may be fluidly isolated such that thermosiphon refrigerant in one thermosiphon stage 204A does not mingle with thermosiphon refrigerant in the other thermosiphon stage 204B. The thermosiphon refrigerant used in the thermosiphon stage 204A may be the same refrigerant as the thermosiphon refrigerant used in the thermosiphon stage 204B or a different refrigerant. For example, in some examples, process areas 228A, 228B may be cooled to different temperatures, making it advantageous to use different thermosiphon refrigerants at the respective thermosiphon stages 204A, 204B. Also, for example, thermosiphon evaporators 212A, 212B may of different kinds, making it advantageous to use different thermosiphon refrigerants at the respective thermosiphon stages 204A, 204B.

Figure 3:
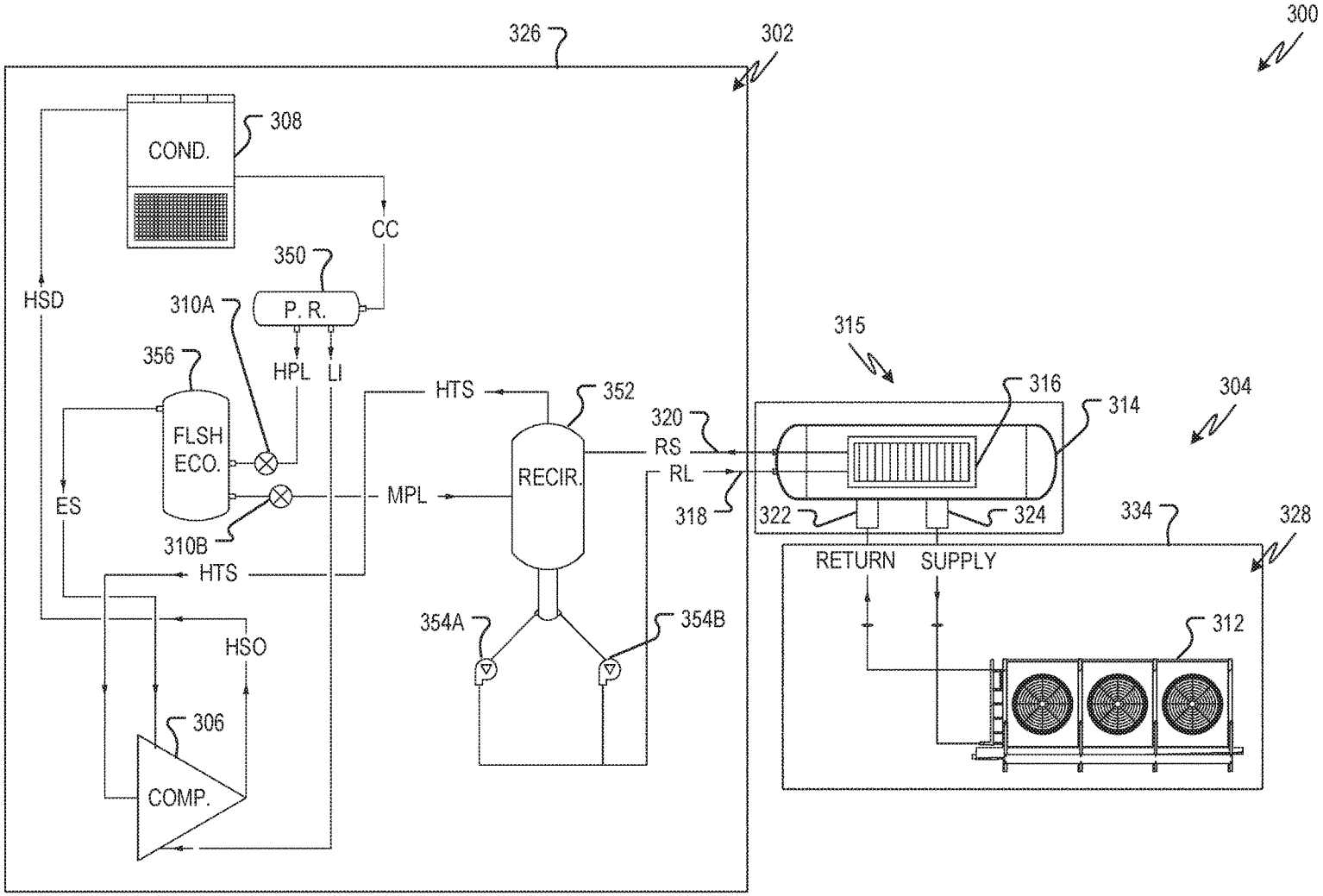
FIG. 3 is a block diagram showing yet another example of a multistage refrigeration system comprising a VCC stage, a thermosiphon stage, and an interface device.

FIG. 3 is a block diagram showing yet another example of a multistage refrigeration system 300 comprising a VCC stage 302, a thermosiphon stage 304, and an interface device 315. In the example of FIG. 3, an interface flow path 316 comprises a heat exchanger, and a vessel 314 comprises a surge drum, where the heat exchanger of the interface flow path 316 is at least partially enclosed by the surge drum of the vessel 314. The surge drum may include a vessel input 322 and a vessel output 324. An input 318 of the interface flow path 316 may receive VCC refrigerant from the VCC stage 302. The VCC refrigerant may absorb heat from the thermosiphon refrigerant within the vessel 314 and provide evaporated VCC refrigerant at output 320.

The thermosiphon stage 304 may circulate the thermosiphon refrigerant between the vessel 314 of the interface device 315 and a thermosiphon evaporator 312, for example, by prompting a thermosiphon force that provides the motive force for circulating the thermosiphon refrigerant, as described herein. For example, the interface device 315 may be positioned at an elevation higher than an elevation of the thermosiphon evaporator 312. In some examples, the interface device 315 is positioned above a roof 334 of a process area 328, with the thermosiphon fluid circulating through the roof 334.

In the example of FIG. 3, the thermosiphon evaporator 312 comprises an air unit. In the air unit, the thermosiphon refrigerant may be circulated through one or more tubes, plates, or other suitable heat exchangers. Fans of the air unit may circulate air from the process area 328 over the heat exchanger, allowing the thermosiphon refrigerant to absorb ambient heat from the process area 328.

The VCC stage 302 of the multistage refrigeration system 300 shows additional components relative to FIGS. 1 and 2 that may be included in some examples. For example, the VCC stage 302 of the system 300 may utilize various valves and tanks to expand the VCC refrigerant after the condenser 308. For example, the refrigeration system 300 may utilize a pilot receiver tank 350 and flash economizer tank 356 that may provide a buffer of VCC refrigerant, which may improve the resiliency of the system 300 to fluctuating loads. For example, VCC refrigerant from the condenser 308 may be provided to the pilot receiver tank 350, where the VCC refrigerant may be at the same pressure as at the condenser 308. From the pilot receiver tank 350, the VCC refrigerant is provided to an expansion device 310A and then to a flash economizer tank 356. The flash economizer tank 356 may store VCC refrigerant and provide it to the recirculator tank 352 via a second expansion device 310B, for example, as needed to handle fluctuating loads. The second expansion device 310B causes further expansion as the VCC refrigerant is provided to a recirculator tank 352.

In some examples, the flash economizer tank 356 is maintained at an intermediate pressure between the pressure of VCC refrigerant at the output of the compressor 306 and the pressure of VCC refrigerant at the input of the compressor 306. For example, the line in FIG. 3, labeled ES, exiting the flash economizer tank 356 may be connected to the compressor 306 at a second output of the compressor 306 that is at the intermediate pressure. Also, a line labeled LI between the pilot receiver tank 350 and the compressor 306 may be for compressor cooling.

From the expansion device 310B, the VCC refrigerant is provided to a recirculator tank 352. At the recirculator tank 352, VCC refrigerant in the liquid phase may sink to the bottom of the recirculator tank 352, where one or more pumps 354A, 354B may provide the VCC refrigerant to the interface flow path 316 (e.g., at input 318). VCC refrigerant may return to the recirculator tank 352 from the output 320 of the interface flow path 316. When it is returned to the recirculator tank 352, the VCC refrigerant may be a low pressure, low temperature vapor. Because the VCC refrigerant returning from the interface flow path 316 is a vapor, it may float above the liquid VCC refrigerant at the recirculator tank 352 that was received from the expansion device 310B. Suction from the compressor 306 may draw the vapor VCC refrigerant off the top of the recirculator tank 352 back to the compressor 306.

The use of the recirculator tank 352, in some examples, increases the efficiency of the system 300. For example, after the VCC refrigerant expands at expansion devices 310A, 310B, some portions of the VCC refrigerant may be in a liquid phase at a low temperature and/or a low pressure, while other portions of the VCC refrigerant may have vaporized at the various expansion devices 310A, 310B. In some examples, it is desirable that VCC refrigerant provided to the interface device 115 be all or mostly in the liquid phase, for example, to improve the heat transfer efficiency of the interface device 115. To facilitate this, the recirculator tank 352 in the example configuration shown in FIG. 3 may circulate VCC refrigerant vaporized at expansion devices 310A, 310B back to the compressor 306, bypassing the interface 315.

Also, optional pumps 354A, 354B shown in FIG. 3 may be used, for example, in implementations where the process area 328 is far from the engine room 326, where the compressor 306 and other components of the VCC stage 302 are located, at a different level than the engine room 326, etc. Pumps 354A, 354B, then, may provide additional pressure to the VCC refrigerant to propel it to the input 318 of the interface flow path 316.

In some examples, the VCC stage of the multistage refrigeration systems described herein may be used to refrigerate an additional process area. For example, an additional VCC evaporator may be included in fluid communication with the expansion device of the VCC stage (or other components performing the function of the expansion device). For example, the VCC evaporator may be arranged in parallel with the interface flow path of the interface device. This arrangement may be beneficial, for example, in applications where different process areas are to be refrigerated to different temperatures. For example, the process area refrigerated by the VCC evaporator may be a freezer at a first temperature (e.g., 0° F.), while the second process area may be a loading dock or other area to be refrigerated to a second temperature higher than the first temperature (e.g., 32° F.).

Figure 4:
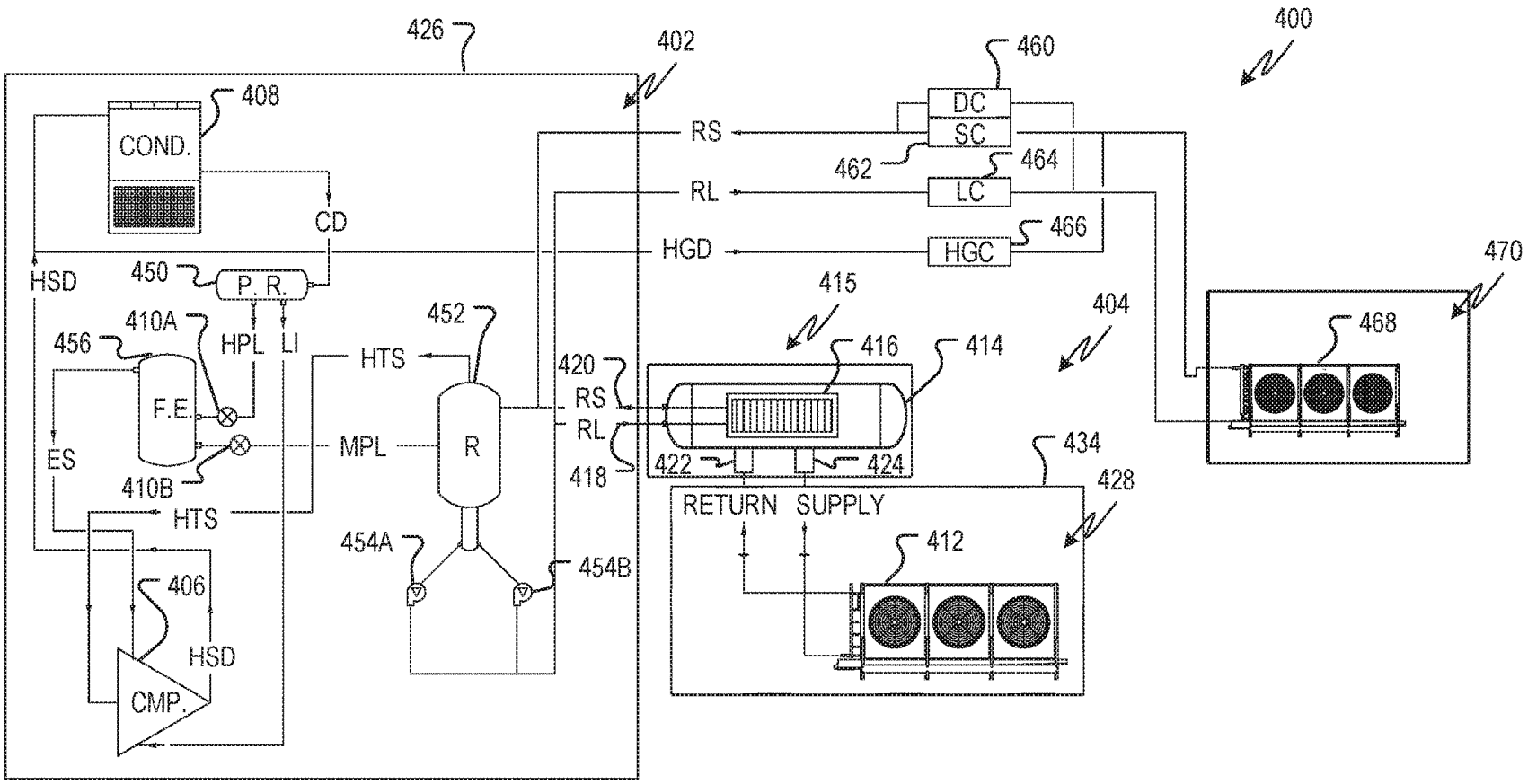
FIG. 4 is a block diagram showing an example of a multistage refrigeration system comprising a VCC stage, a thermosiphon stage, an interface device, and a VCC evaporator for refrigerating multiple process areas.

FIG. 4 is a block diagram showing an example of a multistage refrigeration system 400 comprising a VCC stage 402, a thermosiphon stage 404, an interface device 415, and a VCC evaporator 468 for refrigerating multiple process areas. The thermosiphon stage 404 of the multistage refrigeration system 400 may operate similar to that of thermosiphon stage 304 of FIG. 3. For example, an interface flow path 416 comprises a heat exchanger, and a vessel 414 comprises a vessel input 422 and vessel output 424, where the heat exchanger of the interface flow path 416 is at least partially enclosed by the surge drum of the vessel 414. An input 418 of the interface flow path 416 may receive VCC refrigerant from the VCC stage 402. The VCC refrigerant may absorb heat from the thermosiphon refrigerant within the vessel 414 and provide VCC refrigerant at output 420.

The thermosiphon stage 404 may circulate the thermosiphon refrigerant between the vessel 414 of the interface device 415 and a thermosiphon evaporator 412, for example, by prompting a thermosiphon force to provide the motive force for circulating the thermosiphon refrigerant, as described herein. For example, the interface device 415 may be positioned at an elevation higher than an elevation of the thermosiphon evaporator 412. For example, the interface device 415 may be positioned on a roof 434 of the process area 428, as described herein. As with the example of FIG. 3, the thermosiphon evaporator 412 of FIG. 4 comprises an air unit.

The VCC stage 402 of the multistage refrigeration system 400 may be similar to the VCC stage 302 of FIG. 3. Some or all of the components of the VCC stage 402 may be positioned in an engine room 426. Also, for example, the VCC stage 402 may utilize a pilot receiver tank 450, flash economizer tank 456, and expansion devices 410A, 410B to expand the VCC refrigerant after the condenser 408, as described above. The VCC stage 402 may also utilize a recirculator tank 452 and pumps 454A, 454B, similar to the recirculator tank 352 and pumps 354A, 354B described above. Although the system 400 includes a VCC stage 402 that is arranged similar to the VCC stage 302 of FIG. 3, in some examples, a multistage refrigeration system may include a VCC evaporator added with a thermosiphon stage where the VCC stage has other configurations, such as those of the VCC stages 102 and 202 of FIGS. 1 and 2, respectively.

In the multistage refrigeration system 400, VCC refrigerant may be provided from the expansion device (e.g., or components 450, 456, 410A, 410B) to the VCC evaporator 468 and to the input 418 of the interface flow path 416. Any suitable type of evaporator may be used, however. Also, in the example of FIG. 4, the interface flow path 416 and the VCC evaporator 468 are connected in parallel. That is, VCC refrigerant is provided to the VCC evaporator 468 and to the interface flow path 416 without first having been provided to the other component.

In the example of FIG. 4, the VCC evaporator 468 refrigerates a process area 470 in addition to the process area 428 that is refrigerated by the thermosiphon stage 404. As described herein, the process areas 428, 470 may be refrigerated to different temperatures. For example, the process area 470 may be refrigerated to a temperature that is lower than a temperature to which the process area 428 is refrigerated. As shown in FIG. 4, the VCC refrigerant is provided to the VCC evaporator 468 in the process area 470. For example, the process area 470 may be an area that is not occupied by human workers and/or does not include products or other materials that are easily damaged by a leak of ammonia or another suitable VCC refrigerant.

FIG. 4 also shows additional components that may be included in various examples of the multistage refrigeration systems and methods described herein including defrost control valves 460, suction control valves 462, liquid control valves 464, and hot gas control valves 466.

In the arrangement of FIG. 4, the system 400 may defrost the VCC evaporator 468, for example, utilizing the various valves 460, 462, 464, 466. For example, when frost accumulates on the VCC evaporator 468, the liquid control valve 464 may be closed, to stop the flow of cold VCC refrigerant to the VCC evaporator. When remaining cold VCC refrigerant is evacuated from the VCC evaporator 468, the suction control valve 462 may also be closed. Hot gas control valves 466 may be opened to route hot (e.g., gaseous) VCC refrigerant from the compressor 306 to the VCC evaporator 468, thus heating the VCC evaporator 368 to melt the frost. Resulting liquid VCC refrigerant at the output of the VCC evaporator may be routed through defrost control valves 460 back to the recirculator tank 452. In other examples, electrically generated heat and/or ambient air may be provided to defrost the VCC evaporator 468. In some examples, valves similar to the valves 460, 462, 464, 466 may be included to control the flow of VCC refrigerant to the flow path 416 and/or to defrost the flow path 416 in the manner described.

Figure 5:
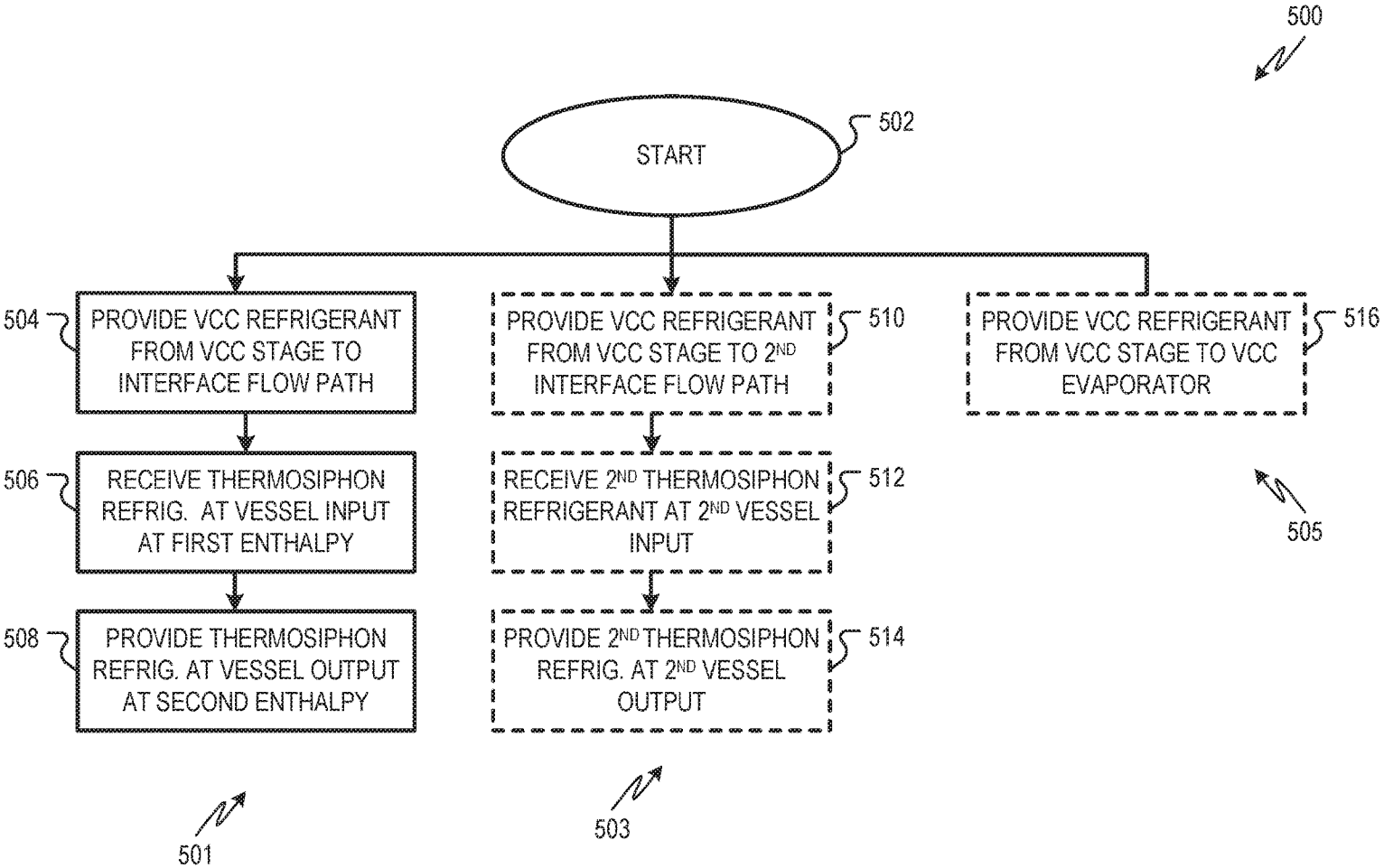
FIG. 5 is a flowchart showing one example of a process flow that may be executed, for example, to operate a multistage refrigeration system as described herein.

FIG. 5 is a flowchart showing one example of a process flow 500 that may be executed, for example, to operate a multistage refrigeration system as described herein. The process flow 500 includes three columns 501, 503, 505. Column 501 shows operations that may be performed to operate a multistage refrigeration system comprising a VCC stage and a thermosiphon stage, for example, as described with respect to FIG. 1. Column 503 shows operations that may be performed to operate a multistage refrigeration system that includes an optional second thermosiphon stage, for example, as described herein with respect to FIG. 2. Column 505 shows operations that may be performed to operate a multistage refrigeration system comprising an optional VCC evaporator, for example, as described with respect to FIG. 5. In some examples, a multistage refrigeration system includes both a second thermosiphon stage and a VCC evaporator. Such a multistage refrigeration system may perform all of the columns 501, 503, 505. In various examples, however, operations for one or both of the columns 503, 505 may be omitted.

At operation 502, the multistage refrigeration system may be started. This may include, for example, activating a compressor and/or one or more pumps at the VCC stage that provide a motive force for circulating the VCC refrigerant (e.g., compressor 106, 206, 306, 406, pumps 354A, 354B, 454A, 454B, etc.).

At operation 504, the VCC stage may provide VCC refrigerant to the interface flow path of an interface device, as described herein. Thermosiphon refrigerant may circulate between the interface device and a thermosiphon evaporator. For example, at operation 506, thermosiphon refrigerant may be received at a vessel input at a first enthalpy. In some examples, the thermosiphon refrigerant is also received at least partially in a liquid phase. In some examples, at least half of the thermosiphon refrigerant received at the vessel input is in a vapor phase. In some examples, greater than half of the thermosiphon refrigerant that is received at the vessel input is in the vapor phase. In some examples, at least 75% of the thermosiphon refrigerant that is received at the vessel input is in the vapor phase. In some examples, substantially all of the thermosiphon refrigerant that is received at the vessel input is in the vapor phase.

At the interface device, the thermosiphon refrigerant releases heat to the VCC refrigerant and, in some examples, is completely or partially condensed to a liquid phase. At operation 508, thermosiphon refrigerant may be provided from the vessel of the interface device (e.g., at the vessel output) to the thermosiphon evaporator at a second enthalpy that is lower than the first enthalpy. That is, for example, the thermosiphon refrigerant may have released heat to the VCC refrigerant, as described, to lower its enthalpy. In some examples, thermosiphon refrigerant at the second enthalpy is at least partially in a liquid phase. In some examples, greater than half of the thermosiphon refrigerant that is output at the vessel output is in the liquid phase. In some examples, at least 75% of the thermosiphon refrigerant that is output at the vessel output is in the liquid phase. In some examples, substantially all of the thermosiphon refrigerant that is output at the vessel output is in the liquid phase. As described herein, operations 504, 506, 508 may generate a thermosiphon force that tends to circulate the thermosiphon evaporator between the interface device (e.g., the vessel) and the thermosiphon evaporator.

The optional operations of column 503 may be executed, for example, when the multistage refrigeration system includes a second thermosiphon stage. As illustrated, the optional operations of column 503 may be executed in parallel to the operations 504, 506, 508. At operation 510, the VCC stage may provide VCC refrigerant to an interface flow path of a second interface device. Second thermosiphon refrigerant may circulate between the second interface device and a second thermosiphon evaporator. For example, at operation 512, second thermosiphon refrigerant may be received at a vessel input of a vessel of the second interface device at a first enthalpy (which may be the same as or different from the first enthalpy of the other thermosiphon stage). In some examples, the second thermosiphon refrigerant is also received at least partially in a liquid phase. In some examples, at least half of the second thermosiphon refrigerant received at the vessel is in a vapor phase. In some examples, greater than half of the second thermosiphon refrigerant that is received at the vessel input is in the vapor phase. In some examples, at least 75% of the second thermosiphon refrigerant that is received at the vessel input is in the vapor phase. In some examples, substantially all of the second thermosiphon refrigerant that is received at the vessel input is in the vapor phase.

At the second interface device, the second thermosiphon refrigerant may be cooled by the VCC refrigerant and, in some examples, completely or partially condense to a liquid phase. At operation 514, the second thermosiphon refrigerant may be provided from the vessel of the second interface device (e.g., at the vessel output) at a second enthalpy that is lower than the first enthalpy. The thermosiphon refrigerant may be at least partially in a liquid phase. In some examples, greater than half of the second thermosiphon refrigerant that is output at the vessel output is in the liquid phase. In some examples, at least 75% of the second thermosiphon refrigerant that is output at the vessel output is in the liquid phase. In some examples, substantially all of the second thermosiphon refrigerant that is output at the vessel output is in the liquid phase. As described herein, operations 510, 512, 514 may generate a second thermosiphon force that tends to circulate the second thermosiphon evaporator between the interface device (e.g., the vessel) and the second thermosiphon evaporator.

The optional operation of column 505 may be executed, for example, when the multistage refrigeration system includes a VCC evaporator, for example, in parallel with the thermosiphon stage as shown in FIG. 4. At operation 516, the VCC stage may provide the VCC refrigerant from the VCC stage to a VCC evaporator, such as the VCC evaporator 468 of FIG. 4. The VCC evaporator may cool an additional process area, as described.

The above description is intended to be illustrative, and not restrictive. For example, the above-described examples (or one or more aspects thereof) can be used in combination with others. Other embodiments can be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims.

Also, in the above Detailed Description, various features can be grouped together to streamline the disclosure. However, the claims cannot set forth every feature disclosed herein as embodiments can feature a subset of said features. Further, embodiments can include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

Example 1 is a multistage refrigeration system comprising: a vapor compression cycle (VCC) stage to circulate a VCC refrigerant, the VCC stage comprising: a compressor; a condenser; and an expansion device; a first thermosiphon stage to circulate a first thermosiphon refrigerant, the first thermosiphon stage comprising a first evaporator at a first elevation; and a first interface device comprising: a first interface flow path in fluid communication with the compressor, the condenser, and the expansion device to receive the VCC refrigerant; and a first vessel comprising: a first vessel input to receive the first thermosiphon refrigerant at least partially in a vapor phase; and a first vessel output to output the first thermosiphon refrigerant towards the first evaporator at least partially in a liquid phase, wherein first vessel at least partially encloses the first interface flow path to put the VCC refrigerant in thermal communication with the first thermosiphon refrigerant, and wherein the first vessel is at a second elevation higher than the first elevation to generate a first thermosiphon force to circulate the first thermosiphon refrigerant between the first vessel and the first evaporator.

In Example 2, the subject matter of Example 1 optionally includes wherein the first vessel input is to receive the first thermosiphon refrigerant at a first temperature, and wherein the first vessel output is to provide the first thermosiphon refrigerant to the first evaporator at a second temperature lower than the first temperature.

In Example 3, the subject matter of any one or more of Examples 1-2 optionally includes wherein more than half of the first thermosiphon refrigerant received at the first vessel input is in the vapor phase, and wherein more than half of the first thermosiphon refrigerant output at the first vessel output is in the liquid phase.

In Example 4, the subject matter of any one or more of Examples 1-3 optionally includes wherein the VCC stage further comprises a second evaporator in fluid communication with at least the compressor, the condenser, the expansion device, and the first interface flow path.

In Example 5, the subject matter of Example 4 optionally includes wherein the first evaporator is positioned in a first room of a building and the second evaporator is positioned at a second room of the building.

In Example 6, the subject matter of any one or more of Examples 1-5 optionally includes wherein the first vessel is positioned above a roof of a building and the first evaporator is positioned below the roof of the building.

In Example 7, the subject matter of any one or more of Examples 1-6 optionally includes a second thermosiphon stage to circulate a second thermosiphon refrigerant, the second thermosiphon stage comprising a second evaporator at a third elevation; and a second interface device comprising: a second interface flow path in fluid communication the compressor, the condenser, and the expansion device to receive the VCC refrigerant; and a second vessel comprising: a second vessel input to receive a second thermosiphon refrigerant at least partially in the vapor phase; and a second vessel output to output the second thermosiphon refrigerant towards the second evaporator at least partially in a liquid phase, wherein the second vessel at least partially encloses the second interface flow path to put the VCC refrigerant in thermal communication with the second thermosiphon refrigerant, and wherein the second vessel is at a fourth elevation higher than the third elevation to generate a second thermosiphon force to circulate the second thermosiphon refrigerant between the second vessel and the second evaporator.

In Example 8, the subject matter of any one or more of Examples 1-7 optionally includes wherein the first interface device comprises a shell-and-tube heat exchanger, wherein the first interface flow path comprises a tube portion of the shell-and-tube heat exchanger, and wherein the first vessel comprises a shell portion of the shell-and-tube heat exchanger.

In Example 9, the subject matter of any one or more of Examples 1-8 optionally includes wherein the first interface device comprises a plate-and-shell heat exchanger, wherein the first interface flow path comprises a first plate flow path of the plate-and-shell heat exchanger.

In Example 10, the subject matter of any one or more of Examples 1-9 optionally includes wherein a mass of the VCC refrigerant in the VCC stage is greater than a mass of the first thermosiphon refrigerant in the first thermosiphon stage.

Example 11 is a method of operating a multistage refrigeration system comprising a vapor compression cycle (VCC) stage, a first thermosiphon stage, and a first interface device comprising a first interface flow path and a first vessel that at least partially encloses the first interface flow path, the method comprising: providing a VCC refrigerant from the VCC stage to the first interface flow path positioned at least partially within the first vessel, wherein the first vessel comprises a first thermosiphon refrigerant, and wherein the VCC refrigerant absorbs heat from the first thermosiphon refrigerant at the first interface device to generate a first thermosiphon force to circulate the first thermosiphon refrigerant between the first vessel and a first evaporator that is at least partially below the interface device.

In Example 12, the subject matter of Example 11 optionally includes receiving the first thermosiphon refrigerant at an input of the first vessel at a first temperature; and providing the first thermosiphon refrigerant at an output of the first vessel at a second temperature lower than the first temperature.

In Example 13, the subject matter of Example 12 optionally includes providing the first thermosiphon refrigerant from the first vessel to the first evaporator through a roof of a building, wherein the first evaporator is below the roof.

In Example 14, the subject matter of any one or more of Examples 11-13 optionally includes wherein more than half of the first thermosiphon refrigerant received at a first vessel input is in a vapor phase, and wherein more than half of the first thermosiphon refrigerant that is output at a first vessel output is in a liquid phase.

In Example 15, the subject matter of any one or more of Examples 11-14 optionally includes providing the VCC refrigerant from the VCC stage to a second evaporator that receives the VCC refrigerant in parallel with the first interface flow path.

In Example 16, the subject matter of Example 15 optionally includes wherein the first evaporator is positioned in a first room of a building and the second evaporator is positioned at a second room of the building.

In Example 17, the subject matter of any one or more of Examples 11-16 optionally includes providing the VCC refrigerant from the VCC stage to a second interface flow path positioned at least partially within a second vessel of a second interface device, wherein the second vessel comprises a second thermosiphon refrigerant, and wherein the VCC refrigerant absorbs heat from the first thermosiphon refrigerant at the second interface device to generate a second thermosiphon force to circulate the second thermosiphon refrigerant between the second vessel and a second evaporator that is at least partially below the second interface device.

In Example 18, the subject matter of any one or more of Examples 11-17 optionally includes wherein a mass of the VCC refrigerant is greater than a mass of the first thermosiphon refrigerant.

Example 19 is a system comprising: a vapor compression cycle (VCC) stage to circulate a VCC refrigerant; a first thermosiphon stage to circulate a first thermosiphon refrigerant; and a first interface device comprising: a first interface flow path in fluid communication with the VCC stage; and a first vessel that at least partially encloses the first interface flow path, wherein the first vessel is to receive a first thermosiphon refrigerant, wherein the VCC refrigerant at the first interface flow path is in thermal communication with the thermosiphon refrigerant at the first vessel, wherein more than half of the first thermosiphon refrigerant received at the first vessel is in a vapor phase, wherein the first vessel is to output the first thermosiphon refrigerant to a first evaporator positioned below the first interface device to generate a first thermosiphon force to circulate the first thermosiphon refrigerant between the first vessel and the first evaporator, and wherein more than half of the first thermosiphon refrigerant that is output to the first evaporator is in a liquid phase.

In Example 20, the subject matter of Example 19 optionally includes wherein a mass of the VCC refrigerant in the VCC stage is greater than a mass of the first thermosiphon refrigerant in the first thermosiphon stage.

What is claimed is:

1. A multistage refrigeration system comprising:

a vapor compression cycle (VCC) stage to circulate a VCC refrigerant, the VCC stage comprising:
- a compressor;
- a condenser; and
- an expansion device;

a first thermosiphon stage to circulate a first thermosiphon refrigerant, the first thermosiphon stage comprising a first evaporator at a first elevation; and a first interface device comprising:
- a first interface flow path in fluid communication with the compressor, the condenser, and the expansion device to receive the VCC refrigerant; and
- a first vessel comprising:
  - a first vessel input to receive the first thermosiphon refrigerant at least partially in a vapor phase; and
  - a first vessel output to output the first thermosiphon refrigerant towards the first evaporator at least partially in a liquid phase, wherein first vessel at least partially encloses the first interface flow path to put the VCC refrigerant in thermal communication with the first thermosiphon refrigerant, and wherein the first vessel is at a second elevation higher than the first elevation to generate a first thermosiphon force to circulate the first thermosiphon refrigerant between the first vessel and the first evaporator.

2. The multistage refrigeration system of claim 1, wherein the first vessel input is to receive the first thermosiphon refrigerant at a first temperature, and wherein the first vessel output is to provide the first thermosiphon refrigerant to the first evaporator at a second temperature lower than the first temperature.

3. The multistage refrigeration system of claim 1, wherein more than half of the first thermosiphon refrigerant received at the first vessel input is in the vapor phase, and wherein more than half of the first thermosiphon refrigerant output at the first vessel output is in the liquid phase.

4. The multistage refrigeration system of claim 1, wherein the VCC stage further comprises a second evaporator in fluid communication with at least the compressor, the condenser, the expansion device, and the first interface flow path.

5. The multistage refrigeration system of claim 4, wherein the first evaporator is positioned in a first room of a building and the second evaporator is positioned at a second room of the building.

6. The multistage refrigeration system of claim 1, wherein the first vessel is positioned above a roof of a building and the first evaporator is positioned below the roof of the building.

7. The multistage refrigeration system of claim 1, further comprising:

a second thermosiphon stage to circulate a second thermosiphon refrigerant, the second thermosiphon stage comprising a second evaporator at a third elevation; and a second interface device comprising:

a second interface flow path in fluid communication the compressor, the condenser, and the expansion device to receive the VCC refrigerant; and a second vessel comprising:

a second vessel input to receive a second thermosiphon refrigerant at least partially in the vapor phase; and a second vessel output to output the second thermosiphon refrigerant towards the second evaporator at least partially in a liquid phase, wherein the second vessel at least partially encloses the second interface flow path to put the VCC refrigerant in thermal communication with the second thermosiphon refrigerant, and wherein the second vessel is at a fourth elevation higher than the third elevation to generate a second thermosiphon force to circulate the second thermosiphon refrigerant between the second vessel and the second evaporator.

8. The multistage refrigeration system of claim 1, wherein the first interface device comprises a shell-and-tube heat exchanger, wherein the first interface flow path comprises a tube portion of the shell-and-tube heat exchanger, and wherein the first vessel comprises a shell portion of the shell-and-tube heat exchanger.

9. The multistage refrigeration system of claim 1, wherein the first interface device comprises a plate-and-shell heat exchanger, wherein the first interface flow path comprises a first plate flow path of the plate-and-shell heat exchanger.

10. The multistage refrigeration system of claim 1, wherein a mass of the VCC refrigerant in the VCC stage is greater than a mass of the first thermosiphon refrigerant in the first thermosiphon stage.

11. A method of operating a multistage refrigeration system comprising a vapor compression cycle (VCC) stage, a first thermosiphon stage, and a first interface device comprising a first interface flow path and a first vessel that at least partially encloses the first interface flow path, the method comprising:

providing a VCC refrigerant from the VCC stage to the first interface flow path positioned at least partially within the first vessel, wherein the first vessel comprises a first thermosiphon refrigerant, and wherein the VCC refrigerant absorbs heat from the first thermosiphon refrigerant at the first interface device to generate a first thermosiphon force to circulate the first thermosiphon refrigerant between the first vessel and a first evaporator that is at least partially below the first interface device.

12. The method of claim 11, further comprising:

receiving the first thermosiphon refrigerant at an input of the first vessel at a first temperature; and providing the first thermosiphon refrigerant at an output of the first vessel at a second temperature lower than the first temperature.

13. The method of claim 12, further comprising providing the first thermosiphon refrigerant from the first vessel to the first evaporator through a roof of a building, wherein the first evaporator is below the roof.

14. The method of claim 11, wherein more than half of the first thermosiphon refrigerant received at a first vessel input is in a vapor phase, and wherein more than half of the first thermosiphon refrigerant that is output at a first vessel output is in a liquid phase.

15. The method of claim 11, further comprising providing the VCC refrigerant from the VCC stage to a second evaporator that receives the VCC refrigerant in parallel with the first interface flow path.

16. The method of claim 15, wherein the first evaporator is positioned in a first room of a building and the second evaporator is positioned at a second room of the building.

17. The method of claim 11, further comprising providing the VCC refrigerant from the VCC stage to a second interface flow path positioned at least partially within a second vessel of a second interface device, wherein the second vessel comprises a second thermosiphon refrigerant, and wherein the VCC refrigerant absorbs heat from the first thermosiphon refrigerant at the second interface device to generate a second thermosiphon force to circulate the second thermosiphon refrigerant between the second vessel and a second evaporator that is at least partially below the second interface device.

18. The method of claim 11, wherein a mass of the VCC refrigerant is greater than a mass of the first thermosiphon refrigerant.

19. A system comprising:

a vapor compression cycle (VCC) stage to circulate a VCC refrigerant;

a first thermosiphon stage to circulate a first thermosiphon refrigerant; and a first interface device comprising:

a first interface flow path in fluid communication with the VCC stage; and a first vessel that at least partially encloses the first interface flow path, wherein the first vessel is to receive a first thermosiphon refrigerant, wherein the VCC refrigerant at the first interface flow path is in thermal communication with the first thermosiphon refrigerant at the first vessel, wherein more than half of the first thermosiphon refrigerant received at the first vessel is in a vapor phase, wherein the first vessel is to output the first thermosiphon refrigerant to a first evaporator positioned below the first interface device to generate a first thermosiphon force to circulate the first thermosiphon refrigerant between the first vessel and the first evaporator, and wherein more than half of the first thermosiphon refrigerant that is output to the first evaporator is in a liquid phase.

20. The system of claim 19, wherein a mass of the VCC refrigerant in the VCC stage is greater than a mass of the first thermosiphon refrigerant in the first thermosiphon stage.

* * * * *